US005816262A

United States Patent [19]

Javnozon

[11] Patent Number: 5,816,262

[45] Date of Patent: Oct. 6, 1998

[54] DIVOT TOOL CIGAR HOLDER DEVICE

[76] Inventor: Marc Javnozon, Lauro Villar 94 - A, Col. Nueva Providencia, Atzc, D.F. 02440, Mexico

[21] Appl. No.: 835,005

[22] Filed: Apr. 7, 1997

[51] Int. Cl.[6] ..... H24D 1/12

[52] U.S. Cl. ..... 131/175; 131/330; 131/329

[58] Field of Search ..... 131/330, 248, 131/329, 175, 259; 294/99.2, 118, 25; 473/282, 286; 248/422, 423

[56] References Cited

U.S. PATENT DOCUMENTS

D. 300,160 3/1989 Johnson ..... D21/234
734,295 7/1903 Blanpied ..... 131/330

*Primary Examiner*—Aaron J. Lewis
*Assistant Examiner*—Charles W. Anderson
*Attorney, Agent, or Firm*—Harrison & Egbert

[57] ABSTRACT

A divot tool and cigar holder device having a first member with an indentation formed at one end and a second member pivotally connected to the first member with an indentation formed at one end. The indentations of the first and second members are suitable in shape and size for receiving a cigar therein. The second member is movable between a first position in flat generally surface-to-surface contact with the first member and a second position angularly offset from the first member. The first member has at least one prong at an end opposite the indentation. The second member is longitudinally slidable with respect to the first member when in the first position.

15 Claims, 1 Drawing Sheet

DIVOT TOOL CIGAR HOLDER DEVICE

TECHNICAL FIELD

The present invention relates to golf accessories or equipment items. More particularly, the present invention relates to cigarette or cigar holders which may be conveniently carried by a golfer for insertion into the earth so as to provide a convenient support for holding a lighted cigarette or cigar while the golfer is making a stroke. Additionally, the present invention relates to divot tools for repairing ball marks or divots.

BACKGROUND ART

It is a common practice for golfers to smoke cigars while playing golf. It is customary, when preparing to take another stroke whether the tee, or the fairway, or even when lost in the rough, or adjacent the green, to lay the lighted cigar on the ground. Typically, the cigar is placed on a grassy spot in an effort to minimize the possibility of the cigar becoming contaminated by dirt. After making the stroke, the golfer again picks up the lighted cigar and continues to play the game.

The practice of laying a lighted cigar on ground is not only unsanitary but it subjects the golfer to the hazards of contamination from poisons and injurious chemicals used in fertilizers and in weed and fungus killers used to combat the growth of undesirable plants. Such impurities can readily be picked up and absorbed by the moistened end of the lighted cigar while laying on the ground. It can then be transferred to the lips or to the face of the golfer so as to cause infection.

It is also a common practice for golfers to carry a variety of tools with them for the golfing activities. One common type of tool is a divot tool which is used to repair ball marks or divots. Whenever such tools are used, it is important that such tools be of a convenient size for easy storage in the shirt pocket of the golfer. Large cumbersome types of tools are inconvenient and are seldom used.

In the past, various tools have issued relating to devices for supporting cigars and/or cigarettes while playing golf. For example, U.S. Design Pat. No. 375,815, issued on Nov. 19, 1996 to B. Kagasoff shows a combined cigarette holder and divot tool. The divot tool includes a pair of prongs at one end. A central body member extends upwardly from the prong so as to support a channel member at an end opposite the prongs. The channel member is sized so as to support cigars or cigarettes therein.

U.S. Pat. No. 3,001,529 issued on Sep. 26, 1961 to H. T. Watson describes a golf smoke tee which can be used so as to support a cigarette therein. The device includes a tee portion which includes a pointed end suitable for insertion into the earth. At the upper end of the tee portion is a slot or channeled member which allows the receipt of the cigarette therein. This patent describes a variety of ways in which the cigarette can be supported by the tee.

U.S. Pat. No. 4,627,621, issued on Dec. 9, 1986, to John R. Tate describes a golf accessory which serves as both a divot tool and a clip. The clip can be used for attachment to a belt, cap, shoe or golf bag of the golfer. The accessory includes a looped return behind a disk-shaped body which defines a saddle, facing concave upwardly, and a concave dish. The dish is configured as a spherical segment having a radius equal to the radius of a golf ball. The disk has a pair of legs which perform the function of a divot repair tool and allows the accessory to be used as a stand so as to support the grip of a golf club above the grass.

U.S. Pat. No. 5,152,524, issued on Oct. 6, 1992, to S. M. Brown describes a golf accessory device which includes a pair of lateral arms which extend laterally beyond a main body for supporting the grip of a golf club handle above the ground. Inclined planar grip supporting surfaces are provided for frictionally retaining the golf grip. Prongs are provided as a stable anchor into the ground for the device and also as a divot tool.

U.S. Pat. No. 5,226,647, issued on Jul. 13, 1993, to G. E. Notarmuzi describes a multi-purpose golfer's accessory. This accessory has a straight edge which provides a scraping device. A pair of prongs provide a green repair mechanism. A cigarette holder is provided at an end of the device opposite the prongs.

U.S. Pat. No. 5,305,999, issued on Apr. 26, 1994, to John Tate describes a golf accessory which has a flat planar disk-shaped metal shield from the edge of which a pair of legs extend in generally parallel fashion. A transverse groove is defined on the top of the device opposite the legs. The groove is of a size suitable for cradling a cigarette inserted therein.

None of these prior art devices effectively functions as a divot tool and a cigar holder. In virtually all of the circumstances, the device is a cumbersome three-dimensional device which is inconveniently carried. Although these devices can support a cigarette therein, they are not particularly configured to support a cigar in a desired fashion. Any strong clipping action onto the cigar can damage the cigar so as to make it unsmokable. Many of these prior art devices are not designed so as to minimize the contact between the device and the cigar.

It is an object of the present invention to provide a divot tool and cigar holder device which can support a cigar above the earth.

It is another object of the present invention to provide a divot tool and cigar holder device which can be easily folded and stored in a shirt pocket.

It is a further object of the present invention to provide a divot tool and cigar holder device which supports the cigar with a minimal amount of contact.

It is a further object of the present invention to provide a divot tool and cigar holder device which effectively operates to repair divots.

It is another object of the present invention to provide a divot tool and cigar holder device which is easy to use, relatively inexpensive, and easy to manufacture.

These and other objects and advantages of the present invention will become apparent from a reading of the attached specification and appended claims.

SUMMARY OF THE INVENTION

The present invention is a divot tool and cigar holder device that comprises a first member having an indentation formed at one end and at least one prong at an opposite end, and a second member pivotally connected to the first member. The second member has an indentation at an end opposite the pivotal connection. The indentation of the first member and the indentation of the second member are suitable for receiving portions of the cigar therein.

The second member is movable between a first position in flat generally surface-to-surface contact with the first member and a second position angularly offset from the first member. The second member is longitudinally slidable with respect to the first member when in the first position. In particular, the first member has a first slot formed transverse to a length of the first member. The second member has a portion extending through the first slot so as to form the pivotal connection of the second member with respect to the first member. The first member has a second slot formed transverse therein. The second slot is formed between the first slot and the prong. The second member has a projection extending through this second slot when in the first position. The first member has a generally planar configuration with a central offset portion. The first slot is formed adjacent one end of the offset portion. The second slot is formed adjacent to an opposite end of the offset portion. In particular, the second member has an upper portion with an indentation formed therein. The second member has a mid-portion of a lesser width than the upper portion. This mid-portion extends through the first slot. The second member also has a bottom portion of a lesser width than the mid-portion. This bottom portion extends through the second slot when the second member is in the first position.

The indentation of the first member is of a semi-circular configuration. This semi-circular indentation has a radius of between one-quarter inch and one-half inch. The indentation of the second member has an identical configuration as the indentation of the first member.

The first member has a pair of prongs extending from an end of the first member opposite the indentation. Each of these pair of prongs has a pointed end. The pair of prongs are in spaced generally parallel relationship. A transverse surface extends between the pair of prongs.

The first member and the second member have a thickness of no more than ¼ inch when in the first position. The second member extends at an angle of between 45° and 90° with respect to the first member when in the second position. When the prongs are inserted into the earth, the device serves to support the cigar in generally parallel relationship to the earth.

DETAILED DESCRIPTION OF THE INVENTION

Figure 1:
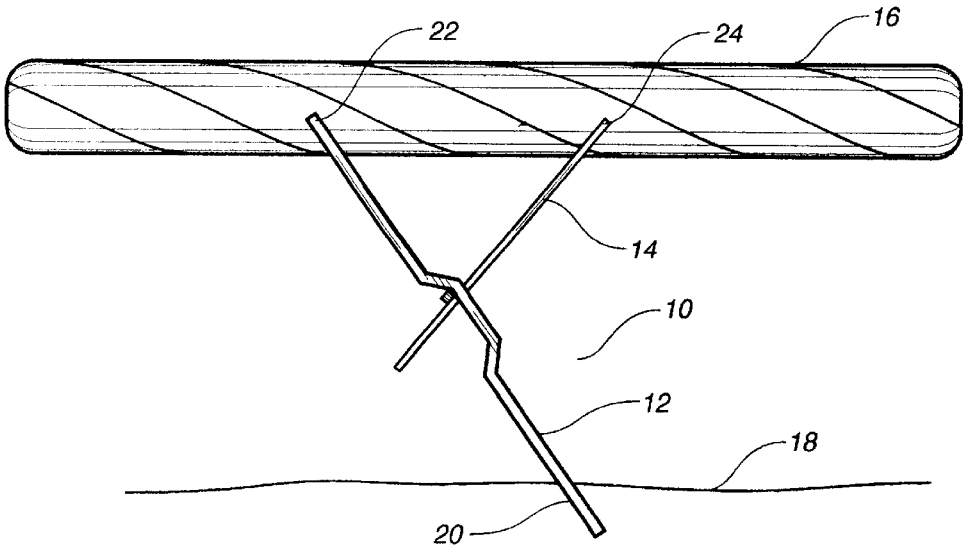
FIG. 1 is a side elevational view showing the device of the present invention as supporting a cigar above the earth.

Referring to FIG. 1, there is shown at 10 the divot tool and cigar holder device in accordance with the preferred embodiment of the present invention. As can be seen in FIG. 1, the device 10 includes a first member 12 and a second member 14. The second member 14 is pivotally connected to the first member 12 so as to support a cigar 16 in generally parallel relationship to the earth 18. The first member 12 has at least one prong 20 at an end opposite the cigar 16 so as to allow the device 10 to be inserted into the earth. As will be described hereinafter, the first member 12 has an indentation at end 22 suitable for receiving the cigar 16 therein. The second member 14 has an indentation at end 24 which is also suitable for receiving another portion of the cigar 16 therein.

In FIG. 1, it can be seen that the second member 14 is pivotted so as to be angularly offset from the first member 12. In the preferred embodiment of the present invention, the angle of offset between the first member 12 and the second member 14 is between 45° and 90°. In particular, a 60° angle is shown in FIG. 1. Each of the members 12 and 14 is of a relatively thin section of metal or plastic. As such, the device 10 can be conveniently folded flat by moving the second member 14 into generally surface-to-surface contact with the first member 12 (in the manner shown in FIG. 3).

As can be seen in FIG. 1, the first member 12 and the second member 14 serve to support the cigar 16 in generally parallel relationship to the earth 18. As such, contact between the cigar 16 and the earth 18 is avoided. Because each of the members 12 and 14 are of a relatively thin construction, there is minimal contact between each of the members 12 and 14 and the surface of the cigar 16. As such, contamination between the device 10 and the cigar 16 is minimized. Each of the indentations at the ends 22 and 24 of members 12 and 14, respectively, receives the exterior surface of the cigar therein without exerting any "pinching" forces upon the cigar 16. As such, damage to the cigar 16 is avoided. Since the device 10 can be conveniently folded into a flat configuration, the device 10 can be easily stowed in the shirt pocket of the golfer or in the pants pocket of the golfer. The prongs 20 at the end of the first member 12 have a suitable configuration for repairing divots. As such, the device 10 can be used for divot repair and also conveniently used as a cigar holder.

Figure 2:
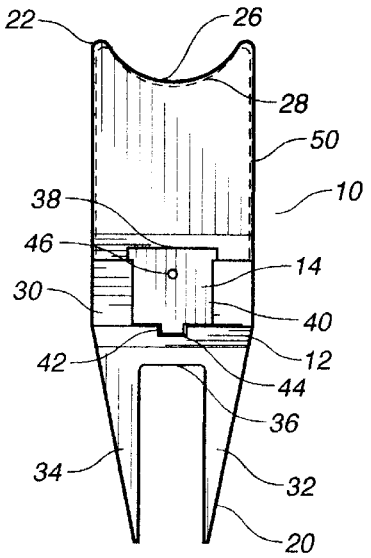
FIG. 2 is a back view showing the device of the present invention.

FIG. 2 shows a back view of the first member 12 with the second member 14 extending through a slotted area. As illustrated in FIG. 2, the device 10 is in its flat folded configuration. In this "first position", the second member 14 (illustrated in broken line fashion) will be in generally flat surface-to-surface contact with the first member 12.

In FIG. 2, it can be seen that the first member 12 has an indentation 26 formed at its upper end 22. The indentation 26 is of a generally semi-circular configuration. The radius of this semi-circular configuration should be between one-quarter inch and one-half inch. As such, the generally semi-circular configuration will be of a proper size for receiving the exterior surface of cigar 16. The second member 14 (as illustrated in broken line fashion) has a semi-circular indentation 28 formed at its upper end. The indentation 28 will be of a configuration virtually identical as the configuration of the indentation 26. As such, the indentations 26 and 28 will have a size and shape suitable for receiving the exterior surface of cigar 16.

The first member 12 is of a generally planar configuration with a central offset portion 30. A mid-portion of the second member 14 extends through the offset portion 30 so as to allow the second member 14 to be locked in its surface-to-surface contact with the first member 12. Prongs 20 include a first prong 32 and a second prong 34. Each of the prongs 32 and 34 have pointed ends. A transverse surface 36 will extend between the prongs 32 and 34.

The first member 12 has a first slot 38 formed transverse to a length of the first member 12. As can be seen, a mid-portion 40 of the second member 14 extends through this slot 38 so as to form a pivotal connection between the second member 14 and the first member 12. The first member 12 also has a second slot 42 formed transverse therein. The second slot 42 is formed between the first slot 38 and the prongs 20. As can be seen, the second member 14 has a projection 44 which extends through the second slot 42 when the second member 14 is in the first position. The first slot 38 is formed at one end of the offset portion 30. The second slot 42 is formed at an opposite end of the offset portion 30. A stop button 46 is formed or affixed onto the surface of the second member 14 in the mid-portion 40 so as to prevent the second member 14 from sliding entirely through the slot 38.

It can be seen in FIG. 2 that the second member 14 has an upper portion 50 with a width generally matching the width of the first member 12. The indentation 28 is formed in this upper portion 50. The mid-portion 40 is of lesser width than the upper portion 50. The projection 44 is of lesser width than the mid-portion 40.

Figure 3:
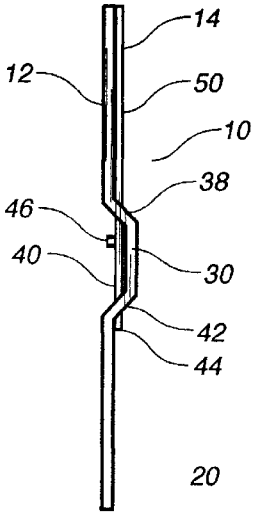
FIG. 3 is a side view of the device of the present invention in its planar configuration.

FIG. 3 shows a side view of the device 10 with the second member 14 in flat surface-to-surface contact with the first member 12. The offset portion 30 is illustrated, with particularity, in FIG. 3. It can be seen that the mid-portion 40 of the second member 14 extends through the slot 48 at one end of the offset portion 30. The projection 44 will extend through the slot 42 at the opposite end of the offset portion 30. Stop button 46 is formed along the mid-portion 40 of the second member 14 so as to prevent the second member 14 from sliding completely through the slot 38.

Figure 4:
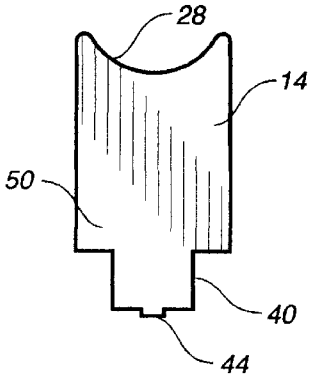
FIG. 4 is an isolated view of the second member as used in the device of the present invention.

FIG. 4 shows an isolated view of the second member 14. In particular, in FIG. 4, it can be seen that the upper portion 50 has a generally rectangular configuration. The indentation 28 is formed at the top of the upper portion 50 of the second member 14. The mid-portion 40 of the second member 14 is of lesser width than the upper portion 50. The projection 44 is located at the bottom of the second member 14 and is of lesser width than the mid-portion 40.

In normal use, when the device 10 is in its "first position", as illustrated in FIG. 3, the projection 44 will extend through the slot 42 so as to be in abutment with a surface of the first member 12. This relationship will prevent the pivotal movement of the second member 14 with respect to the first member 12.

When it is desired to use the device 10 as a cigar holder, then it is necessary to pivotally and angularly move the second member 14 with respect to the first member 12 so as to be in the configuration shown in FIG. 1. This is accomplished by applying a pushing force to the upper portion 50 of the second member 14 such that the second member 14 slides longitudinally upwardly along the surface of the first member 12. This longitudinal sliding motion will cause the projection 44 to slide upwardly through the slot 42 so as to be free of its abutting relationship with the surface of the first member 12. The stop button 46 will limit the sliding motion of the second member 14. Once the projection 44 is free of the slot 42, the second member 14 will pivot angularly with respect to the first member 12. This will allow the device 10 to be in position for the receipt of a cigar 16 therein.

As can be seen in FIGS. 3 and 4, the device 10 has a generally flat configuration when in its first position. The second member 14 is also of a planar configuration. In actual use, the first member and the second member will have a thickness of no more than one-quarter inch when in the first position.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A divot tool and cigar holder device comprising:

a first member having an indentation formed at one end, said indentation having a shape and size suitable for receiving a cigar therein, said first member having at least one prong at an opposite end; and a second member pivotally connected to said first member, said second member having an indentation at an end opposite the pivotal connection, said indentation of said second member having a shape and size suitable for receiving another portion of the cigar therein, said second member being movable between a first position in flat generally surface-to-surface contact with said first member and a second position angularly offset from said first member, said first member having a first slot formed transverse to a length of said first member, said second member having a portion extending through said first slot so as to form the pivotal connection of said second member with respect to said first member, said first member having a second slot formed transverse to the length of said first member therein, said second slot formed between said first slot and said prong, said second member having a projection extending through said second slot when in said first position.

2. The device of claim 1, said second member being longitudinally slidable with respect to said first member when in said first position.

3. The device of claim 1, said indentation of said first member being a semi-circular indentation formed at said one end, said semi-circular indentation having a radius of between one-quarter inch and one-half inch.

4. The device of claim 3, said indentation of said second member having an identical configuration as said indentation of said first member.

5. The device of claim 1, said first member having a generally planar configuration with a central offset portion, said first slot being formed adjacent one end of said offset portion, said second slot being formed adjacent an opposite end of said offset portion.

6. The device of claim 1, said second member having an upper portion with a first width, said upper portion having said indentation formed therein, said second member having a mid-portion of a lesser width than said upper portion, said mid-portion extending through said first slot, said second member having a bottom portion of a lesser width than said mid-portion, said bottom portion extending through said second slot when said second member is in said first position.

7. The device of claim 1, said first member having a pair of prongs extending from an end of said first member opposite said indentation, each of said prongs having a pointed end.

8. The device of claim 7, said pair of prongs being in spaced generally parallel relationship, said first member having a transverse surface extending between said pair of prongs.

9. The device of claim 1, said second member being of a generally planar configuration.

10. The device of claim 1, said first member and said second member having a combined thickness of no more than ¼ inch when in said first position.

11. The device of claim 1, said second member being at an angle of between 45° and 90° with respect to said first member when in said second position.

12. A divot tool and cigar holder device comprising:

a first member having an indentation formed at one end, said indentation having a shape and size suitable for receiving a cigar therein, said first member having at least one prong at an opposite end; and a second member pivotally connected to said first member, said second member having an indentation at an end opposite the pivotal connection, said indentation of said second member having a shape and size suitable for receiving another portion of the cigar therein, said prong being inserted into the earth; and a cigar received within said indentation of said first member and within said indentation of said second member, said first and second members supporting said cigar in generally parallel relationship to the earth.

13. A divot tool and cigar holder device comprising:

a first member having an indentation formed at one end, said indentation having a shape suitable for receiving a cigar therein, said first member having at least one prong at an opposite end; and a second member connected to said first member, said second member having an indentation at one end, said indentation of said second member suitable for receiving another portion of the cigar therein, said second member being movable between a first position in flat generally surface-to-surface contact with said first member and a second position angularly offset from said first member, said first member having a first slot formed transverse to a length of said first member, said second member having a portion extending through said first slot so as to form a pivotal connection of said second member with respect to said first member, said first member having a second slot formed transversely therein, said second slot formed between said first slot and said prong, said second member having a projection extending through said second slot when in said first position.

14. The device of claim 13, said first member having a generally planar configuration with a central offset portion, said first slot being formed adjacent one end of said offset portion, said second slot being formed adjacent an opposite end of said offset portion.

15. The device of claim 14, said second member having an upper portion with a first width, said upper portion having said indentation formed therein, said second member having a mid-portion of a lesser width than said upper portion, said mid-portion extending through said first slot, said second member having a bottom portion of a lesser width than said mid-portion, said bottom portion extending through said second slot when said second member is in said first position.

* * * * *